US008104139B2

(12) United States Patent
Martens

(10) Patent No.: US 8,104,139 B2
(45) Date of Patent: Jan. 31, 2012

(54) METHOD AND APPARATUS FOR REMOVING THE CONTENTS FROM A PIPE

(75) Inventor: Johannes Cornelius Antonius Martens, Oosterhout (NL)

(73) Assignee: Fluidor Equipment B.V., Raamsdonksveer (NL)

( * ) Notice: Subject to any disclaimer, the term of this patent is extended or adjusted under 35 U.S.C. 154(b) by 33 days.

(21) Appl. No.: 12/306,741

(22) PCT Filed: Jun. 19, 2007

(86) PCT No.: PCT/EP2007/005441

§ 371 (c)(1),
(2), (4) Date: Sep. 30, 2009

(87) PCT Pub. No.: WO2008/000381

PCT Pub. Date: Jan. 3, 2008

(65) Prior Publication Data

US 2010/0018555 A1 Jan. 28, 2010

(30) Foreign Application Priority Data

| | | |
|---|---|---|
| Jun. 29, 2006 | (EP) | 06076321 |
| Jul. 25, 2006 | (EP) | 06076469 |
| Oct. 16, 2006 | (EP) | 06076887 |
| Dec. 14, 2006 | (EP) | 06077228 |

(51) Int. Cl.
*B08B 9/032* (2006.01)

(52) U.S. Cl. ..... 15/406; 15/104.05

(58) Field of Classification Search ..... 15/406, 15/301, 409, 104.05; 134/22.12, 102.2, 103.2, 134/111, 166 C, 169 A, 169 C, 169 R
See application file for complete search history.

(56) References Cited

U.S. PATENT DOCUMENTS

| | | | |
|---|---|---|---|
| 4,059,858 | A | 11/1977 | Lambel et al. |
| 6,752,159 | B1 | 6/2004 | Kavadeles et al. |
| 2003/0131886 | A1 | 7/2003 | Walker |

FOREIGN PATENT DOCUMENTS

| | | |
|---|---|---|
| DE | 31 43 031 | 5/1983 |
| EP | 0 634 229 | 1/1995 |
| GB | 2 268 994 | 1/1994 |
| WO | WO 01/17700 | 3/2001 |

OTHER PUBLICATIONS

International Search Report for PCT/EP2007/005441 mailed Nov. 9, 2007.

*Primary Examiner* — Dung Van Nguyen
(74) *Attorney, Agent, or Firm* — Nixon & Vanderhye P.C.

(57) ABSTRACT

Method of removing the contents from a pipe (1)comprising forcing a gas flow through the pipe, the pipe having a pipe volume, an inlet end and an outlet end (9), characterized in that the gas flow is forced into the pipe (1) at the inlet end by applying a gas pressure decreasing from an initial pressure to a lower final pressure to remove at least parts of the contents from the pipe and maintaining that lower final pressure to remove the remaining contents from the pipe and apparatus for removing the contents from a pipe by forcing a gas flow through a pipe (1) having an inlet end and an outlet end (9), comprising gas flow generating means (5) and a container (3) having an inlet and having an outlet connectable to the inlet end of the pipe (1).

8 Claims, 2 Drawing Sheets

METHOD AND APPARATUS FOR REMOVING THE CONTENTS FROM A PIPE

This application is the U.S. national phase of International Application No. PCT/EP2007/005441 filed 19 Jun. 2007 which designated the U.S. and claims priority to European Patent Application No(s). 06076321.6 filed 29 Jun. 2006, 06076469.3 filed 25 Jul. 2006, 06076887.6 filed 16 Oct. 2006 and 06077228.2 filed 14 Dec. 2006, the entire contents of each of which are hereby incorporated by reference.

The invention relates to a method of removing the contents from a pipe comprising forcing a gas flow through the pipe having a pipe volume, an inlet end and an outlet end.

Such method is known from EP-A-1220722. In this document a two-step process is disclosed. In the first step a gas is forced through a pipe at a high pressure in order to discharge the bulk of the pipe contents. Only after the pipe contents have been discharged, in a second step a gas is forced through the pipe at a lower pressure.

A disadvantage of this method is the high pressure to be maintained until the end of the first step. As the contents are discharged the volume in which this high pressure is to be maintained increases. This requires a large and powerful means, in practice even a row of coupled blowers, for generating and maintaining a gas flow with the required high pressure.

Aim of the invention is to provide a method for removing the contents from a pipe that requires less powerful gas forcing means to remove the contents from the pipe than the known one.

This aim is achieved according to the invention in that the gas flow is forced into the pipe at the inlet end by applying a gas pressure decreasing from an initial pressure to a lower final pressure to remove at least parts of the contents from the pipe and maintaining that lower final pressure to remove the remaining contents from the pipe.

Removing the contents in the context of the present invention means removing from the pipe at least 95%, preferably at least 98% or even 99%, more preferably at least 99.5 or even 99.9% and most preferably 100% of the amount of the product that in normal operation still could have been transported through the pipe but that is left when the transport is stopped. Such pipe is not blocked but just filled. It is not intended to encompass methods to remove of a blockage in a pipe that impedes its normal operation, like a blocked sewer. In such process the pipe after the blockage has been removed remains filled with the original contents. Known methods, as disclosed e.g. in GB-A-2268994, U.S. Pat. No. 4,059,858 and US 2003/01311886, for such unblocking usually comprise the sudden release of a pressurized gas to induce shock waves to loosen the blockage. The aim of these methods is to unblock the pipe by loosening the blockade. The contents remain in the pipe. These methods are not applicable to clear a pipe in the sense as defined above.

In the method according to the invention the pressure is decreased in a controlled way. A pipe in this context may be circular, square, rectangular, oval or may have any other cross section. A pipe may be a straight one-segment pipe but it may also be a multi-segment and bended, curved, bifurcated multi segment pipe system and the segments may run in different directions between and including horizontally and vertically.

Hereinafter the word clearing may also be used in the same meaning as removing the contents.

Pipes that may require clearing and can be cleared with the method according to the invention are water pipes, pipes in industrial environments such as oil, petrochemical, chemical, drink, food and feed environments, for transferring liquids and slurries. When normal operation stops the pipes will still be filled with the material that was transported. It might be contemplated to install a drain plug at the lowest position of the pipe. However, this will not allow most pipes to be cleared in the above sense since walls and bends of these pipes will have got fouled and sediments and small amounts of contents may be left in certain spots like dead volumes.

The gas applied may be air, nitrogen or any gas allowable in view of products and plant conditions and requirements. The gas applied may contain minor amounts of preferably fluid, additives such as detergents, antiseptic fluids, solvents and other components that can perform an additional function in the clearing process. Minor amounts is to be understood that the additives may form at most 20 vol. %, preferably at most 10 vol. % and more preferably at most 5 vol. % of the total of gas and additives supplied. The additives may be introduced at any stage of the clearing process and at any location of the pipe to be cleared. When normal operation is stopped for clearing, the pipe will be totally or partly filled with the product transferred when in operation. In the method according to the invention the pipe contents are discharged by the gas flow forced into the pipe. The initial pressure preferably is at least 0.05 MPa or preferably at least 0.15 MPa or at least 0.30 MPa and may be as high as the pipe to be cleared can withstand, e.g. even up to 1 or 2 MPa. In practice pressures up to 0.6 MPa have been found to be sufficient depending on the geometry of the pipes to be cleaned. This initial pressure is chosen sufficiently high to cause the pipe contents to be set into motion. It was found that once this has started moving a lower pressure is sufficient to keep it moving, thus avoiding the need to maintain the high initial pressure for a longer time.

Moving and discharging the pipe contents as a plug was found to be the most effective way to clear the pipe from its contents, only leaving a residual film on the pipe wall. Moving as a plug in this context means that the contents occupy the total cross-section of the pipe so the propelling gas remains behind the contents. Once this plug will be punctured by the gas flow, a free path from the inlet of the pipe to the outlet is formed, allowing gas to escape freely rather than to move forward the contents. The reduction of the pressure as applied in the method of the present invention advantageously reduces this risk compared to the known method, where a constantly high pressure is applied.

Thus the part of the contents that will be removed as a plug, further denoted as the bulk of the contents, will be larger than in the known method, making the method according to the invention more effective than the known method.

As the bulk of pipe contents get discharged gradually at the outlet, the pressure to keep the remainder moving is decreased in the method according to the invention. The bulk part thus can be as large as 70% or even 75 or 80% of the contents initially present in the pipe, and preferably is even at least 90 or 95% of said contents. The higher the part of the contents that is removed as the bulk as a plug, the lower the remaining amount that has to be removed and the shorter the total time to remove also the remainder of the contents from the pipe in the consecutive step.

It was found that the final pressure at the end of the bulk discharging may be as low as 0.05 MPa and may even be as low as 0.01 MPa. More preferably this final pressure is at least 0.015 MPa. Preferably the final pressure is kept in the range between 0.01 and 0.05 MPa. Higher final pressures, up to 0.1, 0.2 or even 0.5 MPa, can be used but the advantages of the method according to the invention are most prominent in the specified preferred range whereas outside this range the disadvantage of the known method will gradually come in.

All pressures are overpressures with respect to the environmental, usually normal barometric, pressure. Reducing the pressure during the discharging process has the advantage that the speed of discharge remains at an acceptable level. In the known method it is prescribed that in the first step of the known method the pressure is kept high and the gas velocity low. However, without additional measures, the constantly high pressure during the known clearing process causes gas velocity and consequently the discharge speed of the pipe contents to increase towards the end of the discharging, due to the constant reduction of the mass to be kept in motion. This causes the last part of the bulk of the pipe contents to be explosively expelled from the pipe with very high speed. To reduce this effect, the use of a throttling valve at the pipe exit is applied in the known method. A further advantage of the present invention is that no throttling valve has to be mounted at the end of the pipe to be cleared before starting the clearing process. The pipe may be open ended and no throttling valve or control means for it are required.

After final pressure has been reached, this pressure is maintained or at least a pressure is maintained within the same range as defined above for the final pressure to remove the remainder of the contents that has not been removed in the preceding step. Preferably this maintained pressure it is 0.1 MPa or lower, more preferably 0.05 MPa or lower and preferably 0.01 MPa or higher, more preferably 0.015 MPa or higher. As an example it may be from 0.005 to 0.02 MPa above the final pressure at the moment of bulk discharge. At that stage the bulk of the pipe contents have been discharged from the pipe as a plug and the pipe then will be open to flowing gas over at least a large part of its cross section. There may and usually will, however, be left remaining fouling of the walls or sediments at certain spots like dead volumes which also have to be removed. It was found that maintaining the pressure, after the bulk of the contents have been discharged, within the pressure range as defined above is sufficient to induce a gas flow velocity in the pipe sufficient to entrain any pipe contents sticking to the wall, sediments or other remainders in bends, valves or other elements of the pipe within a certain period of time. When it is observed that the gas leaving the outlet of the pipe does not contain contents anymore or only in an amount that is considered insignificant and allowable, the gas flow will be stopped. Thus the method according to the inventions allows pipes to be cleared in an efficient process, without requiring additional appendages like throttle valves at the outlet of the pipe and without high-power gas forcing means. The gas velocity suitable for removing said sediments and remainders was found to be in the range of 5 or 10 to 30 m/s, preferably in the range of 15 to 25 m/s.

In the method according to the invention a gas flow is forced into the pipe at an initial pressure. A large advantage of the method according to the invention is that it can be conducted with less powerful gas forcing means than the known method. Gas forcing means are required that are able to supply gas with the required initial pressure only in the initial stage, when the empty volume in the pipe and consequently the required gas volume at the initial pressure is only small. As the pipe contents gradually are discharged the gas volume to be kept under pressure increases but at the same time the required pressure decreases. Thus less powerful gas forcing means than those required in the known method may be applied.

The gas forcing means may e.g. be a pump or a blower or any other means that can provide a gas stream through the pipe at the required operational pressures.

In particular when pipes having larger volumes have to be cleared, preferably an initial supply of gas to be forced into the pipe is present in a container having a container volume at a container pressure of at least the initial pressure required to set the pipe contents into motion. This container then can act as gas forcing means for at least one part of the process. Additional gas flow generating means then can be switched on, alone or additionally during the subsequent part of the clearing process. The additional gas flow generating means may e.g. be a pump or a blower or any other means that can provide a gas stream at the required operational pressures.

This container has an inlet and an outlet. At its inlet it can be filled with gas to the required pressure and at its outlet the pressurized gas can be fed through an open/close valve to the pipe to be cleared. Preferably the outlet is provided with a controllable valve, more preferably with a volume- and/or pressure-regulating valve. During the filling of the container the outlet valve will be closed. Once the pressure is at the desired level the valve at the outlet of the container can be opened and the pressurized gas from the container will provide the gas flow with the required initial pressure. Preferably the pressure is gradually raised from a lower value until the pipe contents start to move rather than instantaneously applying the full pressure of the pressurized gas. Thus a smooth operation is achieved and potentially hazardous shock waves in the pipes and puncture of the contents are prevented. As the pipe contents are discharged and the gas volume in the pipe between inlet and moving contents increases the pressure will automatically decrease as envisaged or can be decreased using the control valve at the outlet of the container.

In one embodiment the product of the container pressure and the container volume is at least equal to the product of the final pressure and the total of the pipe volume to be cleared plus the container volume. In this way it is achieved that the desired pressure regime for removing the bulk of the pipe contents can be completed only using the gas contents of the container. In a first alternative embodiment the additional gas flow generating means are switched on at a certain moment as supportive gas forcing means to supply extra gas, e.g. if the container contents are not sufficient to end with the required final pressure.

In a preferred embodiment the pressure in the pipe is built up to set the contents in motion by opening the outlet valve of the container. When the contents are set into moving the pressure in the pipe is reduced to a pressure above 0.02 MPa, preferably above 0.03 MPa and below 0.06 MPa, preferably below 0.05 MPA but before the final pressure has been reached, by controlling the outlet from the container, taking care that the contents are kept in motion. The gas forcing means are switched on then when the pressure has reached a chosen value within the range defined above, this value being above the final pressure, so before the bulk of the pipe contents have been removed, and below the maximal pressure the gas forcing means can build up. The outlet from the container can be closed then. Preferably the outlet is closed when at most 90% or 80, preferably at most 75 or 70% or even 60% of the bulk of the contents has been discharged. The last part of the bulk of the pipe contents then will be expelled by the low pressure air flow from the gas forcing means, thereby considerably reducing the risk on puncture of the contents, securing that these will be removed gently and mainly as a plug. Expelling this plug reduces the flow resistance of the pipe immediately. Due to this reduction of the flow resistance, the flow velocity naturally increases and the pressure will fall down to a final pressure, which is maintained from then on, being sufficient to remove the remainder of the contents from the pipe.

It was found that this method could be applied in a wide range of pipe volumes and lengths and type of pipe contents without the need for an action to be taken exactly when the bulk of the pipe contents have been removed. It was also found that the transition to the lower final pressure occurs in a natural way. Further this embodiment has the advantage that back flow of pipe contents to the gas forcing means is prevented.

In a second alternative embodiment the pressure in the container is chosen higher than required for expelling the bulk of the pipe contents with the desired final pressure. The controllable valve at the outlet then can be set in a position to achieve the desired initial pressure. To assess the proper valve position the system can be provided with one or more pressure and/or flow transmitters or other pressure or flow measuring instruments positioned in the pipe, preferably at the inlet and the outlet of the pipe. The proper valve position can be calculated by a control system to be mentioned hereafter from the signals obtained from the pressure transmitters.

In this second alternative embodiment, when the bulk of the pipe contents have been expelled, the container will contain a remaining amount of pressurized gas that can be used then for removing the remaining pipe contents. Supportive gas forcing means then can be switched on when the pressure of the gas supplied by the container falls below the required final pressure. The volume and pressure of the container may even be chosen such that the amount of energy in the compressed gas and the gas volume are sufficiently high to clear the pipe completely, without applying supportive gas forcing means for clearing the pipe.

Thus, depending on the situation, if a container is applied supportive gas forcing means can be switched on at a certain stage of the clearing process or supportive gas forcing means can be done without at all.

In order to control the proper position of the controllable valve and the opening and closing of the various valves in the system measuring and control means are applied. Suitable examples of control means are computers, PLC's, Digital Process Control systems or combinations of these. The control means can be supplied with information on the process by measuring means as pressure transducers and flow transducers.

In all cases the supportive gas forcing means need not be able to maintain a high pressure in the total pipe volume but only to maintain the lower final pressure and, optionally, to fill the container.

The gas forcing means can be directly connected to the inlet end of the pipe separate from the container. As an alternative the gas forcing means can be connected to the inlet of the container in which case the gas flow from the gas forcing means flow into the pipe through the container.

In case any vertical or rising segments are present in the pipes the container pressure must also account for the gravimetric pressure of the pipe contents in such segments. In that case preferably the container pressure is higher than the total of a gravimetric pressure sufficient to move upwards pipe contents in any rising section of the pipe and the initial pressure. This allows the pipe contents not only be pushed out of the pipe but also to be pushed up through the rising segment into a horizontal segment downstream or to the exit of the pipe. A rising segment in this respect is understood to be a segment running in a direction having a vertical component. In case rising segments of large heights are present, one or more gas inlets on different heights can be mounted in the rising segment(s) for forcing pressurized gas into the pipe, in particular during the high pressure stage, thus assisting in moving the bulk pipe contents upwardly in that rising segment(s).

The bulk of the pipe contents are discharged as a plug and may be collected in a tank and recycled to the production process later on. The remaining sediments and wall fouling will be discharged heavily diluted with gas. This stream may be fed to a separator, e.g. to a cyclone, to separate the gas from the product. This separated product may also be collected for recycling or may be disposed of, e.g. for quality reasons.

After the remainder of the contents has been removed from the pipe by the airflow having the final pressure, that flow may be continued while adding a cleaning fluid to the gas flow.

The invention further relates to an apparatus for clearing a pipe having an inlet end and an outlet end, comprising gas forcing means to generate a gas flow in the pipe having a pressure and a velocity, the gas forcing means being connectable to an inlet end of the pipe, characterized in that said gas forcing means comprise a pressure container connectable to the inlet end of the pipe having a volume of at least 10 liter and resisting to an internal pressure of at least 0.6 MPa and additional gas flow generating means connectable to the inlet end of the pipe, said container being adapted to generate a gas pressure of at least 0.15 MPa at its outlet and said gas flow generating means being adapted to generate a gas flow at 0.06 MPa of at least 100 $m^3/h$ and preferably of at least 200 $m^3/h$, and in that the apparatus comprises measurement and control means adapted to impose a pressure pattern on the gas flow including means to switch on the gas flow generating means when the pressure in the pipe at the inlet has decreased to a preset value.

This apparatus is particularly suitable to carry out the method of the invention. It is fit to carry out the method according to the invention for installations requiring different pressure patterns, as it is adapted to impose a pressure pattern, both the decreasing part and the part maintained at the final pressure, as required. Also the means to switch on the gas flow generating means when the pressure in the pipe has decreased to a preset value allows choosing the final pressure that has to be maintained according to the method of the invention. The preset value then is the chosen final pressure. As elucidated above in the description of the method according to the invention, due to the presence of the container that may function as a high-pressure gas storage it can do with lower power gas flow generating means than the apparatus known from the prior art as in EP-A-1220722. If the gas flow generating means are applied for filling the container, they must at most be fit to fill the container to the required operating pressures and at least to maintain the final pressure required in operation. In this case the gas flow generating means are also connectable to the inlet of the container.

In a second embodiment separate means can be applied for filling the container. As these separate means to fill the container a pump or blower can be applied but also a simple compressor can be applied. This allows the gas flow generating means being designed with even lower capacity since they need only be fit to maintain as supportive gas forcing means the relatively low final pressure rather than having to supply gas with the higher pressure to fill the container. In case separate means are applied to fill the container these can be part of the apparatus but also suitable equipment available at the location may be applied.

The only requirement in that case is that this equipment can be connected to the container and that proper valve means are present to keep the gas in the container when gas-forcing equipment is connected or disconnected.

The gas flow generating means may be connectable to the inlet of the container. They are also connectable to the inlet end of the pipe, that may have two connections then, one for the container and one for the gas flow generating means, equipped with proper valves.

The volume of the container is chosen in combination with the permitted gas pressure in view of the pipe volumes it is intended to clear. For clearing large volume pipes an apparatus having a container having a larger volume and/or permitted pressure than in an apparatus for clearing smaller volume pipes. In practice the container volume will be at least 100 liters; preferably it is at least 200 and more preferably at least 250 liters. The volume generally can be as high as 1500 liters and will usually lie between 500 and 1000 liters. The container is a pressure container and must be able to withstand an internal pressure of at least 0.6, preferably of at least 1 and more preferably at least 2 MPa.

The apparatus can comprise more than one container, each having a different volume, which makes the apparatus more versatile and applicable to clear pipes over a broad range of volumes.

In order to fill the container to the required pressure and to control any additional gas supply by the gas forcing means the apparatus according to the invention further comprises measurement and control means to control the pressure in the container such that a desired pressure pattern in the part of the pipe between the container and the contents is imposed. These means also comprise means to measure the pressure at various positions in the pipe for adapting the gas flow forced into the pipe according to a desired pressure pattern and optionally means to measure the velocity of the airflow. The connection from the container to the inlet end of the pipe contains an open/close valve or preferably a controllable, e.g. a flow or more preferably a pressure regulating valve as control means. Further the apparatus according to the invention will comprise usual elements as electric power supply, control switches and housing, and optionally status display. The apparatus according to the invention may also contain a separator to separate the discharged pipe contents from the gas flow. This separator will be applied when the bulk of the pipe contents have been discharged and the remaining pipe contents become discharged by the final pressure gas flow, heavily diluted with gas. It then serves to separate the pipe contents from the gas allowing recycling of the pipe contents. Preferably the separator is a cyclone.

The invention will be elucidated by the following drawings, in which

Figure 1:
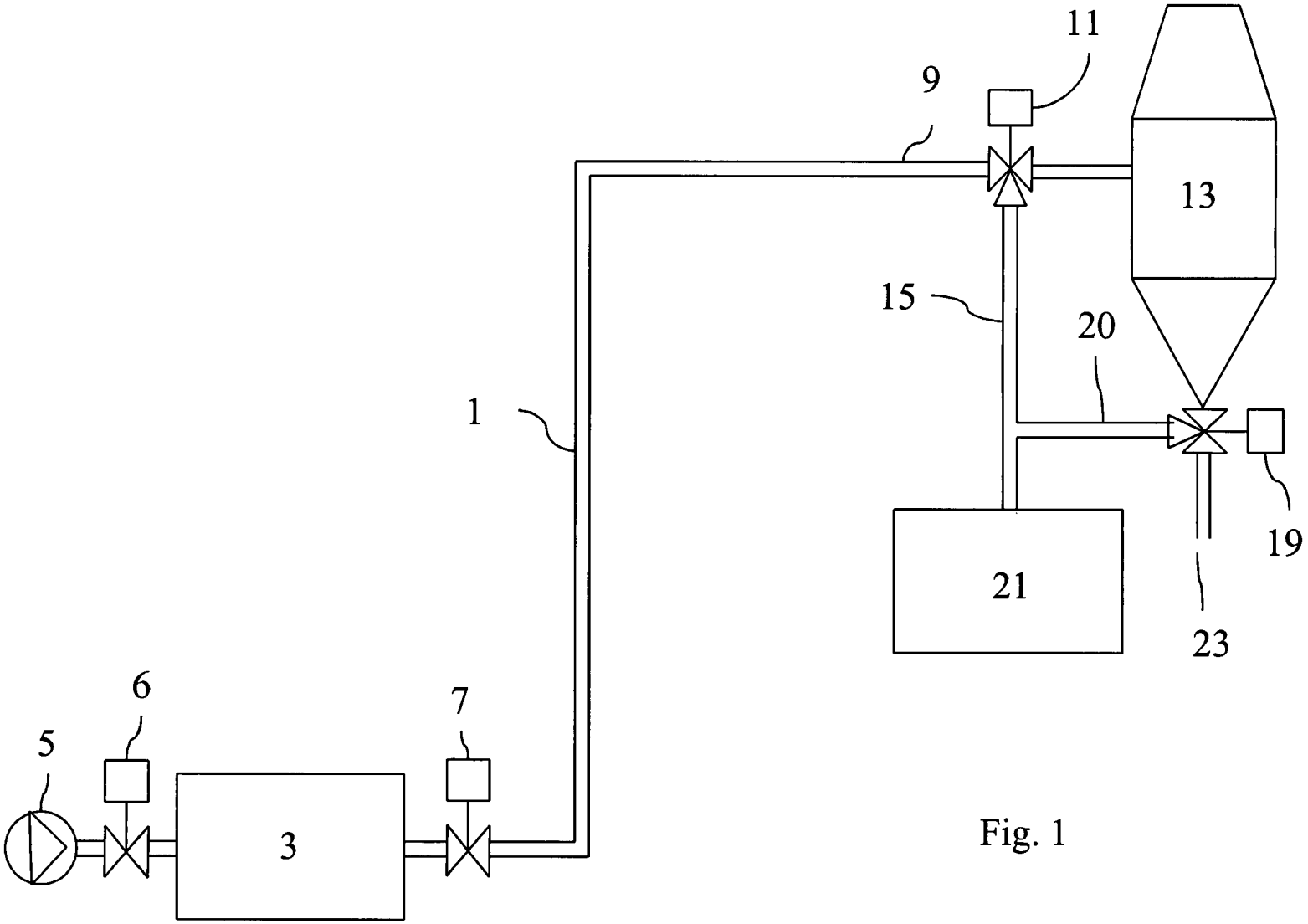
FIG. 1 is a schematic illustration of an apparatus according to the invention comprising a container, wherein the gas flow generating means are connected to the container.

In FIG. 1, 1 is a pipe to be cleared, comprising a vertical section. 3 is a container that is filled with gas under the desired pressure by pump 5. A valve 6 is present between pump 5 and container 1. This can be used if it is preferred to have the bulk of the pipe contents discharged only by the pressurized gas supply of container 3. Container 3 is connected to the inlet end of 1 pipe through valve 7. The outlet end 9 of pipe 1 is terminated by three-way valve 11. When valve 7 is opened the bulk of the pipe contents will be discharged. Valve 11 is set then in the position that it connects outlet end 9 through duct 15 to storage tank 21 in order to catch the product discharged from pipe 1. When the bulk of the pipe contents have been discharged pump 5 forces gas into pipe 1 through container 3 and valve 7. Since the pipe now is open over the main part of its cross section the gas velocity will increase and at the outlet end 9 the remainder of the pipe contents will be discharged, heavily diluted with gas. Valve 11 then is set in the position where it connects the outlet end 9 of pipe 1 to cyclone 13. In this cyclone 13 gas and product will be separated and the product will be directed by three-way valve 19 through line 20 into storage tank 21. In case the separated product would not be suitable for recycling it can be directed to outlet 23 through valve 19 in order to be disposed of.

Figure 2:
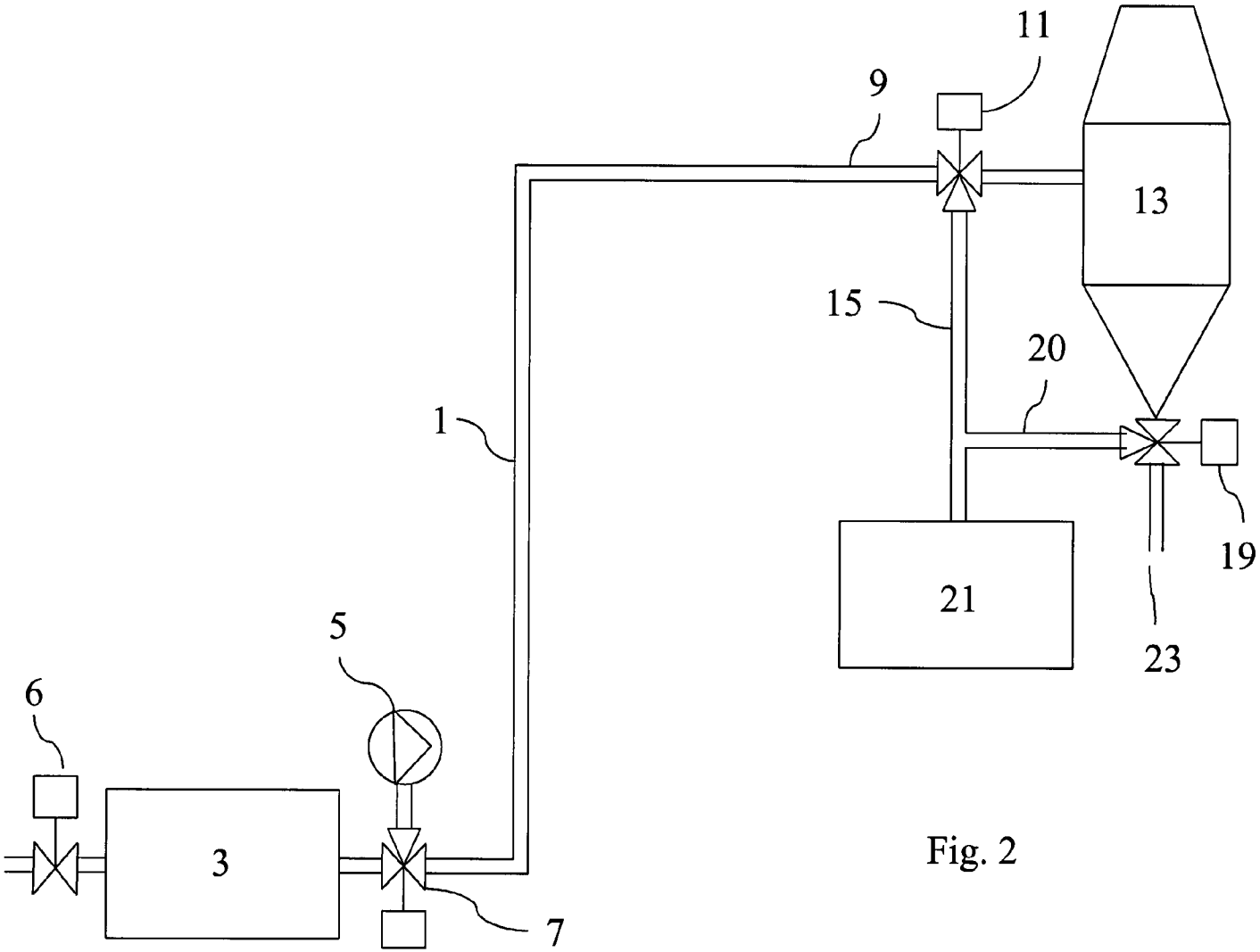
FIG. 2 is a schematic illustration of an apparatus according to the invention comprising a container, wherein the gas flow generating means are connected to the inlet of the pipe and separate equipment can be applied for pressurizing the container.

In FIG. 2 valve 7 now is a three-way valve to which pump 5 is connected. Separate equipment to fill container 3 with gas of the required pressure can be connected to valve 6. To start the clearing process valve 7 is switched to a position wherein the container 3 is connected to pipe 1. The outlet pressure of the container is set to a starting value that is lower than the pressure required to set the contents of pipe 1 in motion. This pressure is gradually increased until the contents are set into motion. From that moment on the pressure is gradually lowered, preventing the velocity of the contents of becoming undesirably high and taking care that the contents keep moving. When the pressure has reached a preset value of between 0.02 and 0.06 MPa, valve 7 is switched to a position wherein the output of container 3 is closed and gas flow generating means 5, which have been switched on already, are connected to pipe 1. The gas flow generating means from that moment on generate a flow with sufficient pressure to keep the contents still in the pipe in controlled motion. When the bulk of the pipe contents have been expelled the flow resistance of the pipe is drastically reduced and a lower final pressure is sufficient then to generate the high velocity flow removing the remainder of the pipe contents. As in FIG. 1 valve 11 redirects the output flow of the pipe outlet 9 from duct 15 to cyclone 13

The invention claimed is:

1. Apparatus for clearing by a gas stream a pipe for transferring liquids and slurries in industrial oil, petrochemical, chemical, drink, food and feed environments, the pipe having an inlet end and an outlet end, wherein the apparatus comprises:

a pressure container, connectable to the inlet end of the pipe, and a supportive gas flow generator connectable to the inlet end of the pipe or to the container, to generate a gas flow in the pipe having a pressure and a velocity, wherein the container is adapted to generate a gas pressure of at least 0.15 MPa at the outlet end of the pipe, and the gas flow generator is adapted to generate a gas flow at 0.06 MPa of at least 100 $m^3/h$;

a controllable pressure regulating valve to connect the supportive gas flow generator with the inlet end of the pipe when the pressure in the pipe at the inlet has decreased to a predefined value; and a controller which imposes a predefined pressure pattern on the gas flow.

2. Apparatus according to claim 1, wherein the apparatus has a volume of at least 100 liter and resisting to an internal pressure of at least 0.6 MPa.

3. Apparatus according to claim 1, further comprising separate equipment for filling the container.

4. Apparatus according to claim 1, wherein the apparatus comprises a separator connectable to the outlet end of the pipe.

5. Apparatus according to claim 4, wherein the separator is a cyclone.

6. Apparatus for clearing contents from a pipe comprising:

a pressure container connectable to an inlet end of the pipe for introducing a gas under an initial pressure into the pipe to generate a gas flow within the pipe so as to remove at least a first portion of the contents from an outlet end of the pipe;

a storage tank for receiving the first portion of the contents discharged from the outlet end of the pipe;

a pump connectable to the inlet end of the pipe or the container for generating a supportive gas flow within the pipe at a subsequent pressure which is lower than the initial pressure to remove a remaining second portion of the contents from the outlet end of the pipe;

a cyclone for receiving the remaining second portion of the contents from the outlet end of the pipe to separate the remaining second portion of the contents from the gas; and a controllable pressure regulating valve connectable to the outlet end of the pipe to connect the pump with the inlet end of the pipe when the pressure in the pipe at the inlet end thereof has decreased to a predefined value, wherein the pressure regulating valve directs the initial first portion of the contents discharged from the outlet end of the pipe when the pressure in the pipe is above the predefined value, and thereafter directs the remaining second portion of the contents discharged from the outlet end of the pipe to the cyclone in response to the pressure in the pipe decreasing below the predefined value.

7. The apparatus as in claim 6, further comprising a cyclone discharge control valve for directing the remaining second portion of the contents separated from the gas by the cyclone to the storage tank.

8. The apparatus as in claim 7, wherein the cyclone discharge control valve is a three-way valve to allow the remaining second portion of the contents separated from the gas by the cyclone to bypass the storage tank.

* * * * *